United States Patent [19]

Flood

[11] 4,207,153

[45] Jun. 10, 1980

[54] ELECTROREFINING CELL WITH BIPOLAR ELECTRODE AND ELECTROREFINING METHOD

[75] Inventor: H. William Flood, Acton, Mass.

[73] Assignee: Kennecott Copper Corporation, New York, N.Y.

[21] Appl. No.: 12,879

[22] Filed: Feb. 16, 1979

[51] Int. Cl.[2] ..... C25C 1/12; C25C 7/00

[52] U.S. Cl. ..... 204/106; 204/256; 204/253; 204/284; 204/285

[58] Field of Search ..... 204/283–285, 204/106–108, 256, 259

[56] References Cited

U.S. PATENT DOCUMENTS

| | | | |
|---|---|---|---|
| 1,792,998 | 2/1931 | Melish | 204/285 |
| 2,331,071 | 10/1943 | Halvorsen | 204/285 |
| 3,620,955 | 11/1971 | Jones | 204/283 |
| 3,928,152 | 12/1975 | Harvey et al. | 204/108 |
| 4,033,839 | 7/1977 | Harvey et al. | 204/108 |

*Primary Examiner*—R. L. Andrews

*Attorney, Agent, or Firm*—John L. Sniado; Anthony M. Lorusso

[57] ABSTRACT

An electrorefining cell includes a bipolar electrode that is comprised of a sheet of acid resistant metal and a basket of the same or similar material attached directly to one side of the sheet, the basket being lined with an acid-resistant filter cloth. A method for electrorefining copper cement in slurry form by piping the slurry into the basket is also shown.

11 Claims, 6 Drawing Figures

ELECTROREFINING CELL WITH BIPOLAR ELECTRODE AND ELECTROREFINING METHOD

BACKGROUND OF THE INVENTION

The invention is related to the electrorefining of metal and in particular to improved bipolar electrodes used in the bipolar series method of electrorefining metal.

In the electrorefining of metal using the series method, a series of bipolar electrodes, unconnected to any electrical circuit, are located between an anode and cathode pair in a cell. When the cell is in operation, metal is plated on the surface of each bipolar electrode that faces the anode; metal is etched away from the surface of the bipolar electrode facing the cathode.

When a series electrode deposition cell is employed for electrorefining of a metal such as copper, the bipolar electrode is typically a slab of that metal. A series cell would normally include only one style of bipolar electrode except for the end anode, which would be slab of the particular crude metal, and the end cathode, which might be a sheet of the same metal or an inert metal (i.e. a starting sheet).

There are many advantages in utilizing series electrodeposition cells for electrorefining. Principal among them are the use of much lower cell currents than in the parallel system of electrodeposition and the elimination of electrical contacts to all but the end electrodes of the cell. The advantage of the series system becomes even greater at high current densities where the parallel system would require the use of low resistance clamps for every electrode, thus complicating the operation and rendering the attainment of the desired close spacing very difficult.

Several problems associated with the series method of electrorefining were solved by an apparatus described in U.S. Pat. No. 3,979,275, which described a method and apparatus for series electrorefining which employed shields to block current bypass and also included an air agitation system to provide the necessary convection to prevent stagnation of the electrolyte used. The system described in the patent has many virtues, but has not in general been applied because of the difficulties in introducing the crude copper slabs to the electrorefining cells.

For example, in the series electrorefining of massive copper, the following methods of fabricating composite bipolar electrodes are possible. The electrode may be cast, by either a blank-up or a blank-down procedure. Pressing, rolling, or explosion-bonding to form a metallurgical bond between crude copper and the blank may be used. Copper may be fastened to the blank by bolts, rivets, or clamps. Electrodeposition may be used. Simple stacking of the plate of impure copper on a permanent blank may be used if there is a horizontal or inclined disposition of the electrodes. All of these methods have disadvantages. An object of the invention accordingly is to provide an improved method and apparatus for introducing the crude copper to an electrorefining system.

The method and apparatus are also useful for directly converting cement (or precipitate) copper into saleable cathode copper. Cement copper when it arrives from the precipitation plant is a finely divided mixture of metallic copper and copper oxides. Material that has been stored in open piles has an analysis that approximates copper oxide. This material, which is wet and contaminated with iron and other impurities, is usually converted into saleable copper by drying it and adding it to the feed to reverbatory furnaces or converters for eventual conversion into anode for electrorefining, or by dissolving the copper in recirculated electrolyte to produce cupric sulfate which is fed to an electrowinning process. The dissolving step requires an oxidation step to convert metallic copper and cuprous copper to the divalent state. A process of drying and fire-refining to produce a lower quality fire-refined product may also be used. These preliminary steps may be avoided with the invention.

Another object of the invention is therefore to provide an improved bipolar electrode that can be used for the electrorefining of cement copper as well as massive copper.

Other objects of the invention will in part be obvious and will in part appear hereinafter.

SUMMARY OF THE INVENTION

Bipolar electrodes are used in a series electrorefining cell, in which each electrode includes a sheet of suitable metal such as titanium or stainless steel and a basket made of screen or perforated metal of the same or similar acid resistant material and attached directly to one side of the sheet. The basket is made so that it can be quickly and easily removed to permit removal of the deposited metal on the opposite side of the sheet and to permit cleaning of the basket. The top of the basket extends above the top of the solution level in the electrolytic cell. A diaphragm is made of an acid-resistant filter cloth and is used to line the basket. The diaphragm serves to retain any fine metals and particularly the insoluble slimes that often contaminate the deposited metal on the cathode. Copper cement in slurry form is electrorefined by piping the slurry into the top of the baskets.

BRIEF DESCRIPTION OF THE DRAWINGS

For a fuller understanding of the nature and objects of the invention, reference should be made to the following detailed description and the accompanying drawings, in which.

DESCRIPTION OF A PREFERRED EMBODIMENT

Figure 2:
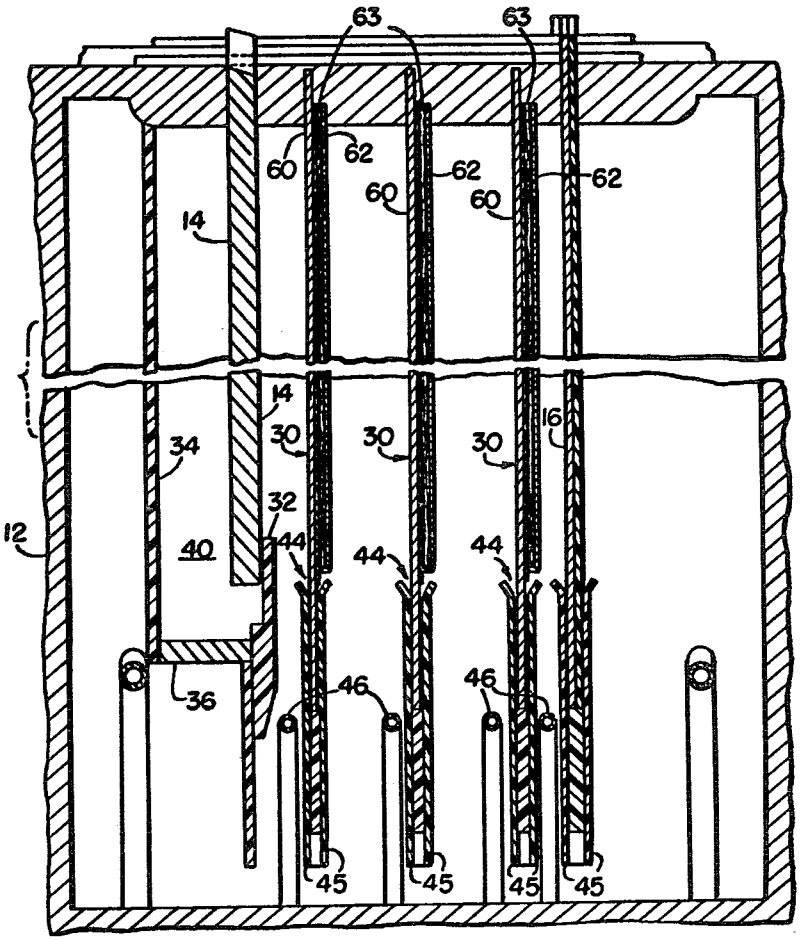
FIG. 2 is a sectional view of the rack in position.
Figure 1:
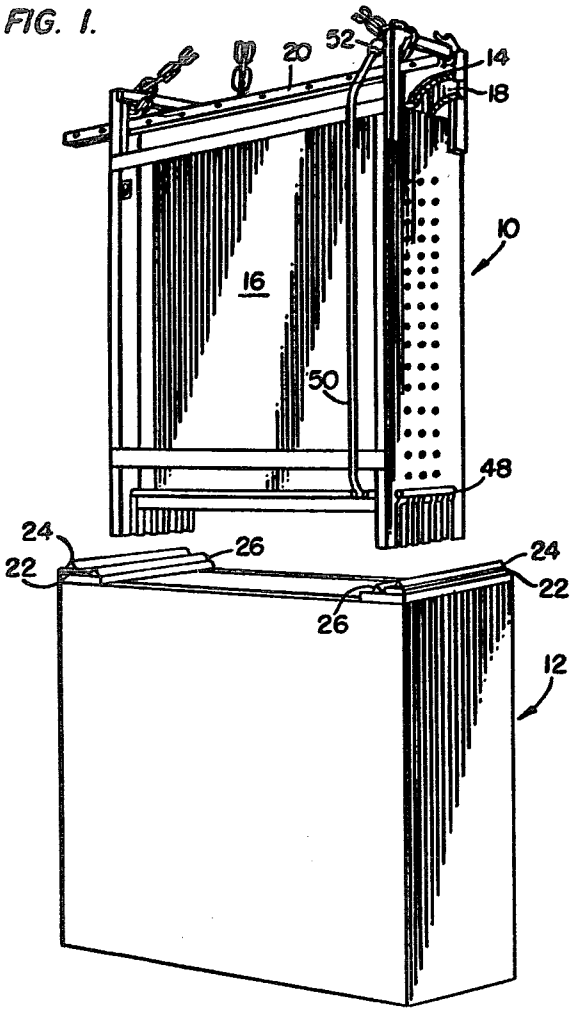
FIG. 1 is a perspective view of a rack of electrodes embodying the invention being lowered into an electrorefining tank.
Figure 3:
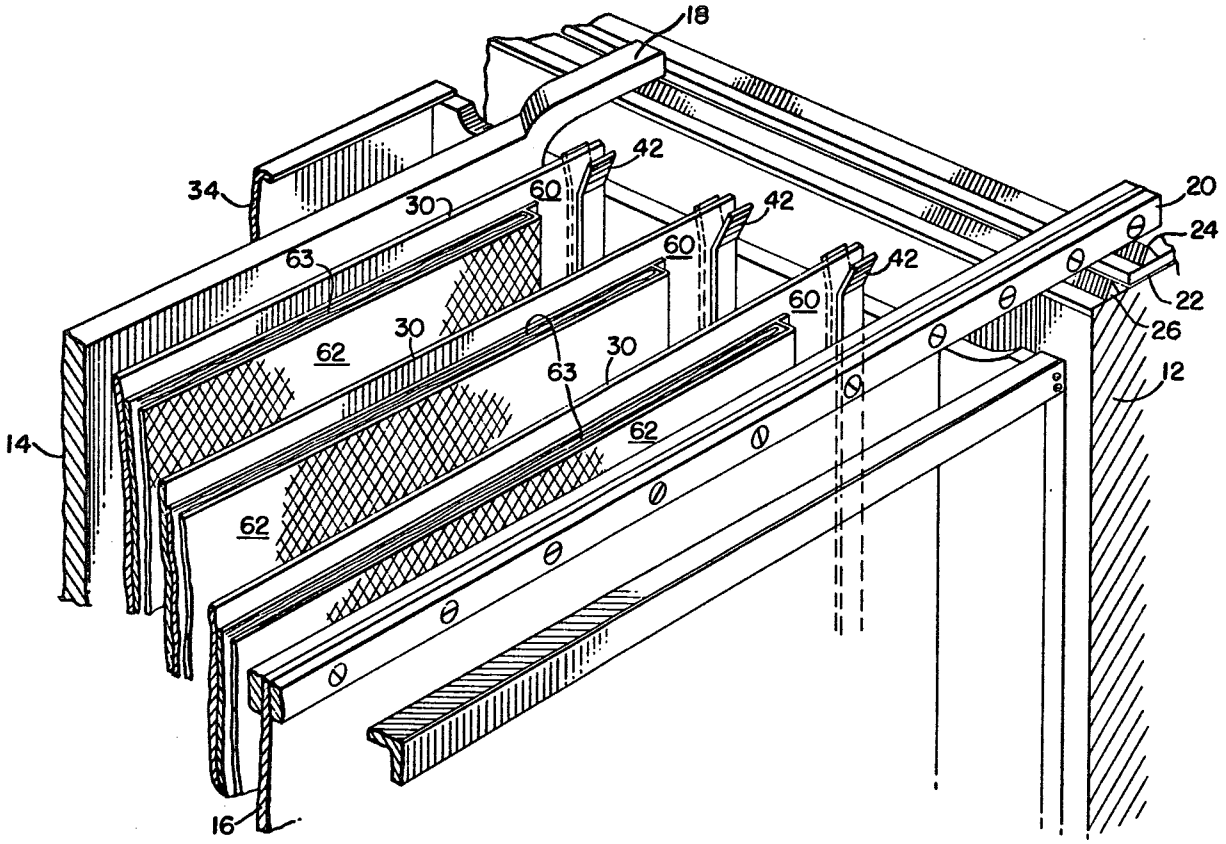
FIG. 3 is a perspective view of a top portion of the rack and tank.

This embodiment is based on a bipolar series electrorefining apparatus described in greater detail in U.S. Pat. No. 3,979,275, the teachings of which are incorporated by reference. The invention consists of an improvement in the bipolar electrode. To set the invention in context, the apparatus is described briefly.

The assembly includes a conveyable rack 10 which can be lowered into an electrolyte tank 12. The rack 10 is formed of a material like polyvinyl chloride that can withstand the corrosive environment of the electrolyte. Various nuts and bolts used to assemble the rack are also formed of polyvinyl chloride or stainless steel where needed. The rack includes an anode 14 and cathode 16. Anode 14 includes anode lug or suspension bars 18; cathode 16 includes cathode suspension bar 20. Either side of the top of the tank 12 includes an insulator 22 upon which rest the cathode current supply bar 24 and anode current supply bar 26. When properly loaded rack 10 is in position in tank 12, bar 20 contacts current supply bars 24 and lug 18 contacts supply bar 26.

Bipolar electrodes 30 are positioned within the cell so that no direct electrical contact is made with the current supply bars 24, 26 or with the end anode 14 and the end cathode 16. When the cell is in operation, current flows from the end anode 14 to the end cathode 16 through the bipolar electrodes 30.

The rack 10 is inclusive of current shields and electrode guides. Anode current shield 32 runs along the bottom and up the two sides of the rack on the face of the anode nearest a bipolar electrode 30 and frames the face of this anode facing the first bipolar electrode. The end wall 34 of the rack is a solid sheet of polyvinyl chloride extending from the top edge of the rack to the bottom portion 36 and together with the anode shield 32 enclosing the entire area of the anode 14 that is not directly opposed to the cathodic face of the first bipolar electrode 30. The current shield 32 and the end wall 34 and the bottom portion 36 form an anode chamber 40. This arrangement prevents current from passing around the sides and bottom of the anode 14 toward the cathode 16. Essentially the only path for the current from the anode 14 to the cathode 16 is through the bipolar electrodes 30. In addition, side shields/guides 42 support the bipolar electrodes 30 and prevent the electrodeposition of metal on the edges of the electrodes. The guides 42 are fixed on the sides of the tank 12 for the entire length of the electrodes 30. They serve to position the bipolar electrodes and prevent the possibility of bypass current traveling along the sides of the cell from the anode to the cathode. They also prevent the electrodeposition of material on the edges of the bipolar electrodes to facilitate removal of deposited copper. Each bipolar electrode is supported on the bottom by a support member 44. These bottom support members 44 extend from side to side of the tank 12 and fix the bottom location of the electrodes 30 in the cell. To provide the proper convection of the electrolyte, the support members 44 are also inclusive of combination/baffle shields 45 which also run from side to side of the tank 12.

The cell includes stainless steel bubble tubes 46 leading to a manifold 48. The cell contains one bubble tube for each interelectrode space defined by opposing electrode faces and the walls of the conveyable rack. The end of air inlet pipe 50 leading to manifold 48 projects out of the electrolyte and terminates with the quick connect fitting 52 for connection to a supply of moist air.

Figure 4:
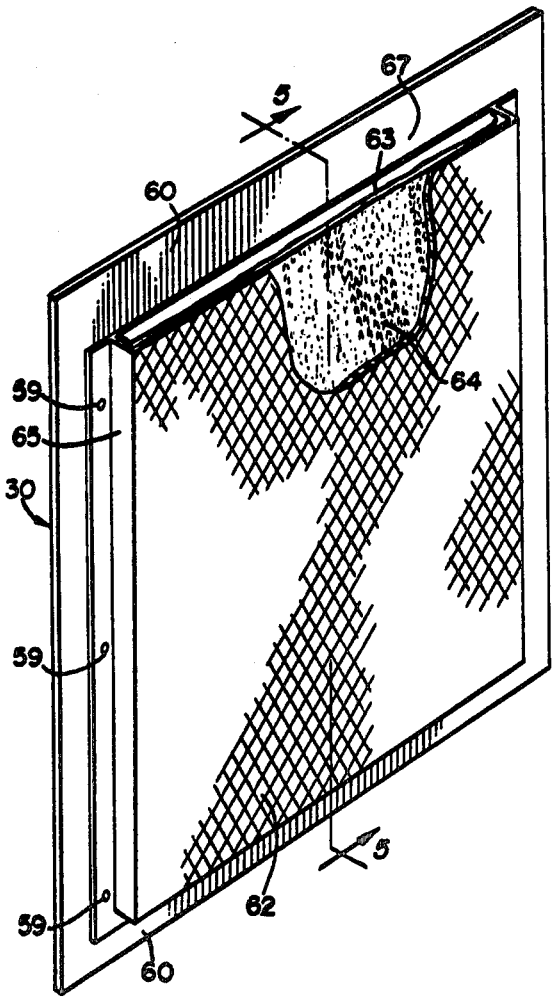
FIG. 4 is a perspective view of a bipolar electrode embodying the invention.
Figure 5:
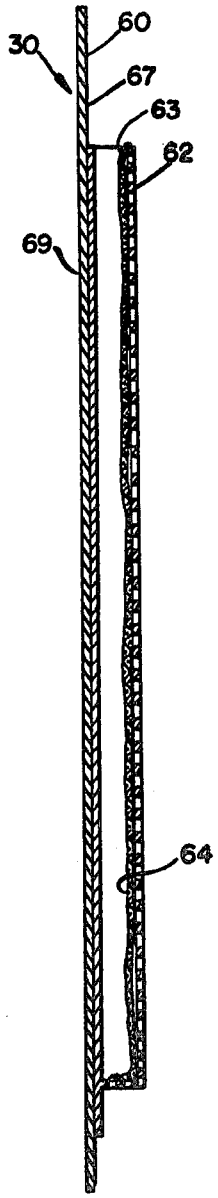
FIG. 5 is a cross-sectional view of the electrode of FIG. 4.

FIGS. 4 and 5 shows one of the bipolar electrodes 30 constructed according to the invention. The electrode 30 is made of an electrochemically suitable metal such as titanium, stainless steel or other acid resistant metal. A suitable metal is one that will withstand the electrolyte and not dissolve in it. The main structure of the electrode 30 is a flat sheet 60 of the selected metal.

A metallic basket 62 made of a screen or perforated metal of the same or similar acid resistant material as the flat sheet 60 is attached by screw fasteners 59 directly to the anode side 67 of the sheet, the side that will face the cathode 16. For example, the basket 62 may be constructed of an expanded metal grid with one-half inch opening or a one-quarter inch grid of No. 4 mesh wire screen. The basket 62 is arranged so that it can be quickly and easily removed by unscrewing fasteners 59. The top 63 of the basket 62 is high enough so that it can extend above the top of the solution level in the tank 12, and the sides 65 of basket 62 are arranged inwardly enough not to interfere with the guides 42 gripping sheet 60 when the electrode 30 is inserted in the rack 10.

A diaphragm 64 lines the basket 62 along the bottom and side away from sheet 60. The diaphragm 64 is made of closely woven, acid resistant filter cloth. Such cloths include materials like cotton duck (canvas), polyacylanitrile such as that sold under the trademark Orlon, Neoprene treated synthetic fibers, and Terylene. Two specific examples of suitable filter fabrics are Webril non-woven fabric made under No. R2401 by the Fiber Products Division of The Kendall Company of Boston, Massachusetts and No. 2503 Nylon or N-1251 Polypropylene, made by the Industrial Products Division of Pellon Corp., 491 Dutton Street, Lowell, Massachusetts.

The operation of the cell will be described for two purposes. One is the electrorefining of cement copper; the other is the electrorefining of massive copper. Cement copper when it arrives from the precipitation plant is a finely divided mixture of metallic copper, copper oxides and various impurities. By using the process described, the wet cement copper can be directly converted into saleable cathode copper.

Figure 6:
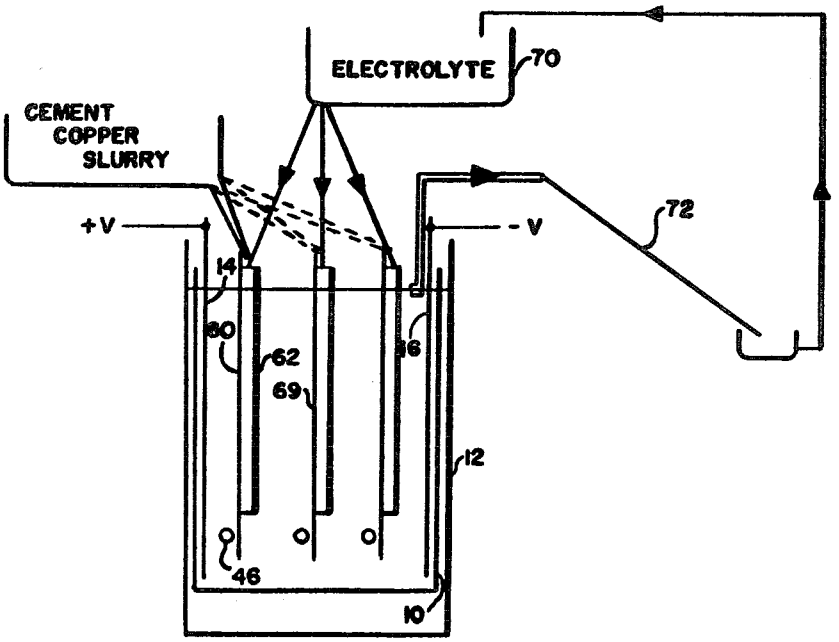
FIG. 6 is a block diagram illustrating the method of the invention for treating copper cement slurry.

Referring to FIG. 6, which illustrates the process, it can be seen that the bipolar electrodes 30 are filled using a slurry of cement copper and water, or recycled electrolyte, as received from the precipitation plant. The electrodes 30 are assembled along with the end electrodes 14 and 16 into the rack 10 containing the bubble tubes 46 and other elements described above. The rack 10 is set into the tank 12 filled with an electrolyte of the desired composition and is connected to a suitable source of DC power. Electrolyte is circulated from a storage tank 70 through suitable manifolds and spouts into the open top of each basket 62 of the electrodes 30. The circulation is carried out so as to minimize the concentration of soluble copper within the baskets 62. Convection of the electrolyte is powered by gas agitation resulting from gas, such as air, supplied to the manifold 48 and thence to the bubble tubes 46. The system provides a fluidized sheet of relatively small, rapidly ascending gas bubbles that together with the turbulence they create, result in vigorous mixing at the cathode surface of the bipolar electrodes 30, where mixing is most needed. The addition of the precipitate copper slurry also assists in maintaining suitable levels of soluble copper in the baskets.

When the cell is in operation, and electric current is passing through the bipolar electrodes 30 from the anode 14 to the cathode 16, copper passes from the basket 62 on the anode side 67 of the electrode 30 through the diaphragm 64 and eventually appears on the cathode side 69 of electrode 30, namely, the side of sheet 60 on which a basket 62 is not hung.

When a portion of the contained copper is dissolved from the basket 62, additional cement copper, contained in the circulating electrolyte, is added routinely to replenish the supply. Electrolyte is continuously overflowed from each space between the electrodes into a launder 72 and returned the storage tank 70. The recirculating electrolyte is not expected to require filtration since slimes and other insolubles will be retained within the filter cloth 64 in the bipolar electrode assembly 30.

A portion of the recirculated electrolyte is treated as required to remove soluble impurities to the required levels to meet commercial specifications. Techniques for that are well known and require no discussion. When a desired quantity of copper has been deposited on the smooth cathode sides of each of the bipolar electrodes 30, the rack 10 is removed from the cell 12 and replaced with another electrode rack assembly.

The individual bipolar electrodes 30 are then removed from the rack 10. The basket assembly 62 is removed from the flat sheet 60 and the slimes along with any undissolved copper are sluiced from the filter cloth 64. The flat sheet 60 is moved to a suitable apparatus where the adhering cathode copper is stripped off, washed and transported to be processed further or to be shipped.

The slimes along with the associated copper may be recirculated to the electrode basket 62 several times in order to build up the concentration of precious metals where they may be accumulated and put into a special electrorefining run designed to remove the contained copper while leaving a concentrated residue of valuable by-products, such as gold, silver and other precious metals, for further processing. The flat sheet 60 is examined and reconditioned and then reassembled with the diaphragm lined basket 62. This assembly is then filled and prepared for insertion in the next available cell as discussed above.

This approach to the conversion of cement copper to directly saleable product bypasses a number of the high cost steps currently needed to make a product suitable for sale. Drying is not required. High quality directly saleable electrolytic cathode is produced. The difficult redissolving step is not needed. Precious metal slimes are quantitatively recovered for further processing. Deleterious slimes are also collected and held to avoid contact with the copper cathode. Cement copper, containing metallic copper and copper oxides, is converted with the minimum amount of electrical power into metallic copper (i.e., cuprous oxide requires only one-half of the electrical energy as compared to copper in the cupric state, while any metallic copper is transferred to the cathode as in the electrorefining mode).

The arrangement for the electrorefining of massive copper is similar to the process described above, except for the dimensions of the particular electrode assemblies 30. Anode scrap or freshly cast copper slabs are cut into shapes that can easily be inserted into the filter cloth lined baskets 62. Purchased industrial copper scrap must be compacted into bales, if not already in that form, and then cut into pieces that are suitable for insertion.

Electrolyte is circulated as previously described. Additional pieces of massive copper can be added directly to the baskets 62 during the run.

When the bipolar electrode 30 is disassembled, any remaining metallic copper can be screened from the slimes, compacted and then cut into shapes for re-insertion into baskets 62 as they are subsequently charged.

The use of the proposed bipolar electrode design bypasses a number of high cost, production limiting steps in the existing electrorefining plants. Electrode spacing can be reduced so that $I^2R$ losses are at a minimum. Highly precise casting of anodes is not required. Anode scrap is not produced and remelting is not required if an entire tank house used this system. In a tank house using conventionally cast anodes, anode scrap, broken anodes, and off-specification anodes can be cut to size and processed directly in the electrolyte cells. Recycling to the anode furnace is not required. Purchased copper scrap can be directly converted to specification grade cathode at a minimum cost.

It will thus be seen that the objects set forth above, including those made apparent form the preceding description, are efficiently attained and, since certain changes may be made in the described product or in carrying out the process described above without departing from the scope of the invention, it is intended that all matter contained in the above description or shown in the accompanying drawings shall be interpreted as illustrative and not in a limiting sense, and that the scope of the invention shall be defined by the following claims.

I claim:

1. A method for the electrorefining of cement copper comprising:

providing a tank for containing electrolyte, providing a conveyable rack which can be loaded with electrodes at a location remote from the tank, said rack being formed of a non-conductive material, providing an anode and a cathode positioned in said rack, providing said rack with a series of bipolar electrodes positioned in said rack and close spaced apart from each other between the anode and cathode, each said bipolar electrode comprising:

a sheet of acid resistant conductive metal, having two planar sides with one of said planar sides acting as an anodic surface and with the other of said planar sides acting as a cathodic surface, a support enclosure of acid resistant material, having walls having openings allowing the free passage of electrolyte therethrough, said support enclosure being mounted on that planar side of said sheet that faces the cathode, and a filter means lining the inside of said enclosure for allowing free passage of electrolyte therethrough and for capturing fine metals and insoluble slimes, loading said rack into said tank, connecting said anode and cathode to suitable sources of DC power, and feeding a slurry of cement copper and electrolyte to said support enclosures.

2. the method of claim 1 further including feeding electrolyte to said support enclosures to minimize the concentration of soluble copper within said support enclosures.

3. The method of claim 2 further including collecting electrolyte overflowed from said tank, and returning it to said support enclosures.

4. The method of claim 3 further including providing a storage tank for the storage and feeding electrolyte to said support enclosures.

5. A series electrodeposition cell comprising:

a. a tank for containing electrolyte;

b. a conveyable rack in the tank which can be loaded with electrodes at a location remote from the tank, said rack being formed of a non-conductive material and including a pair of side walls having slots on the bottom extending through the side walls to allow fluid flow through the side walls, non-conductive bottom support members extending between and secured to each side wall between the slots for supporting electrodes and fixing the bottom position of the electrodes in the cell and providing nonconductive baffles below the electrodes and between the slots for improving electrolyte convection and reducing bypass current from the anode to the cathode along the bottom of the cell, non-conductive electrode guides on the side of the rack for positioning the sides of the electrodes and reducing bypass current along the sides of the cell, said electrode guides extending the entire length of an electrode, means for shielding the anode to prevent current from passing along the sides, bottom and back of the anode toward the cathode;

c. an anode positioned in the rack;

d. a cathode positioned in the rack;

e. a series of bipolar electrodes within the electrode guides and resting on the bottom support members and close spaced apart from each other between the anode and the cathode; and, f. bubble tubes having orifices for generating sheets of relatively small, rapidly ascending bubbles of gas that result in agitation of the electrolyte over the cathode faces of the bipolar electrodes, the portion of the bubble tubes having orifices being positioned between and below the bipolar electrodes, said bubble tubes being positioned in the slots in said sides; said baffles and electrode guides forming compartments within the cell which minimize lateral spreading and contraction of the sheet of bubbles and reducing the possibility of bypass current by blocking the electrical path along the bottom and sides of the electrode, the slots on the bottom of the sidewalls of the rack enabling the electrolyte to circulate throughout the cell in a continuous manner when the upward convection created by the bubbles of gas pushes the electrolyte over the top edge of the rack and down the side of the tank to the bottom of the rack said compartments and bubble tubes producing electrolyte convection which enables the efficient use of high current densities in an electrodeposition process, wherein said bipolar electrodes comprise:

sheets of acid resistant conductive metal, having two planar sides with one of said planar sides acting as an anodic surface and with the other of said planar sides acting as a cathodic surface, acid resistant support enclosures for each bipolar electrode suitable for holding metal to be electrorefined, said support enclosures having walls having openings allowing the free passage of electrolyte therethrough, said support enclosures being mounted on those planar sides of said sheets that face the cathode, and a filter means lining the inside of said enclosures for allowing free passage of electrolyte therethrough and for capturing fine metals and insoluble slimes.

6. A series electrodeposition cell comprising:

a. a tank for containing electrolyte;

b. a conveyable rack in the tank which can be loaded with electrodes at a location remote from the tank, said rack being formed of a non-conductive material;

c. an anode positioned in the rack;

d. a cathode positioned in the rack;

e. a series of bipolar electrodes positioned in said rack and close spaced apart from each other between the anode and the cathode; and, f. bubble tubes having orifices for generating sheets of relatively small, rapidly ascending bubbles of gas that result in agitation of the electrolyte over the cathode faces of the bipolar electrodes, the portion of the bubble tube having orifices being positioned between and below the bipolar electrodes, wherein said bipolar electrodes comprise:

sheets of acid resistant conductive metal, having two planar sides with one of said planar sides acting as an anodic surface and with the other of said planar sides acting as cathodic surface, acid resistant support enclosures for each bipolar electrode suitable for holding metal to be electrorefined, said support enclosures having walls having openings allowing the free passage of electrolyte therethrough, said support enclosures being mounted on those planar sides of said sheets that face the cathode, and a filter means lining the inside of said enclosures for allowing free passage of electrolyte therethrough and for capturing fine metals and insoluble slimes.

7. The electrode of claim 6 in which said support enclosure has an opening at the top through which material to be electrorefined may be inserted into the enclosure.

8. The electrode of claim 6 in which said support enclosure has a dimension perpendicular to said planar side that is relatively short compared to the other dimensions of said enclosure, and said other dimensions of said enclosure are large enough so that said enclosure covers a substantial portion of said planar side.

9. The electrode of claim 6 in which said enclosure is mounted on said sheet by readily detachable means.

10. The electrode of claim 6 in which said filter means is readily removable from said enclosure.

11. For use in a copper electrorefining cell, a bipolar electrode comprising:

a sheet of acid resistant conductive metal, having two planar sides one of which acts as an anodic surface and with the other of said planar side acting as a cathodic surface, a basket of acid resistant material having walls through which electrolyte can freely pass detachably mounted on one of said sides which serves as the anodic surface, a filter means detachably lining the inside of said basket, for allowing electrolyte to freely pass and for capturing fine metals and insoluble slimes.

* * * * *